US005364097A

United States Patent [19]

Lyon

[11] Patent Number: 5,364,097

[45] Date of Patent: Nov. 15, 1994

[54] BATON WITH INTEGRAL PROJECTILE LAUNCHER

[75] Inventor: David Lyon, Belcamp, Md.

[73] Assignee: The United States of America as represented by the Secretary of the Army, Washington, D.C.

[21] Appl. No.: 62,261

[22] Filed: May 17, 1993

[51] Int. Cl.[5] ..... F41C 9/00

[52] U.S. Cl. ..... 273/84 R; 42/1.16; 42/2; 42/69.01

[58] Field of Search ..... 273/84 R, 84 ES; 42/1.16, 52, 2, 8, 9, 10, 12, 69.01, 0.02, 0.03, 1.09

[56] References Cited

U.S. PATENT DOCUMENTS

| | | | |
|---|---|---|---|
| 410,235 | 9/1889 | Draper et al. | 42/52 |
| 2,050,861 | 11/1936 | Rolston . | |
| 2,124,172 | 7/1938 | Wildes et al. | 42/1.16 |
| 2,966,621 | 12/1960 | Voll . | |
| 3,728,809 | 4/1973 | Mulich et al. . | |
| 4,109,912 | 8/1978 | Zentmyer . | |
| 4,416,078 | 11/1983 | Hillberg | 42/69.01 |
| 4,842,277 | 6/1989 | LaCroix . | |
| 4,989,358 | 2/1991 | Aronson et al. . | |
| 5,108,098 | 4/1992 | Ashihara . | |

*Primary Examiner*—Vincent Millin
*Assistant Examiner*—William M. Pierce
*Attorney, Agent, or Firm*—Saul Elbaum; Muzio B. Roberto; Jason Shapiro

[57] ABSTRACT

A police baton sidearm having a baton main body and a crosshandle which is attached in a perpendicular manner to the baton main body at a position longitudinally displaced from the geometric center of the baton main body. The baton main body also houses a recessed trigger ahead of the crosshandle and means for launching a projectile. In order to achieve impact insensitivity a double action only firing mechanism is employed. The baton main body is constructed in two parts to accomodate breech loading and various connection schemes including interrupted and multilead threads on abutting portions of the baton main body. Guide rods or a hinge mechanism may be provided to accomodate one-handed loading. The police baton sidearm may also be equipped with gunsights and a laser pointing device for improving the accuracy of the user's aim.

9 Claims, 9 Drawing Sheets

BATON WITH INTEGRAL PROJECTILE LAUNCHER

GOVERNMENTAL INTEREST

The invention described herein may be manufactured, used and licensed by or for the U.S. Government for governmental purposes without the payment to me of any royalties thereon.

BACKGROUND OF THE INVENTION

I. Field of the Invention

The present invention relates to police batons with crosshandles, and more particularly, to police batons with crosshandles and projectile launching devices.

II. Description of the Prior Art

The law enforcement community has long recognized the need for safe and effective means for controlling individuals who refuse to submit to an officer's show of authority. In response to this need, many nonlethal devices have been devised, however, no one device or method has been accepted as the ideal response in all situations. These weapons operate according to diverse principles, but are easily categorized into one of four groups. These include incapacitation due to the delivery of chemicals, inducing pain through the transfer of kinetic energy, physical restraint, or incapacitation through directed energy (e.g. electric shock, sound, light, etc.).

The standard police baton is generally a straight club which is provided with a grip at one end to facilitate bludgeoning. This type of baton is commonly known as a "billy stick." Another type of police baton is provided with a crosshandle to allow rotation of the club and jabbing by the user. Known in the martial arts as a "tonfa," this type of baton exhibits a crosshandle which is perpendicular to the main baton body at a position which is longitudinally displaced from the geometric center of the baton. The eccentric position of the crosshandle promotes rotation in response to circular arm motion. A user of this type of baton usually grips the crosshandle by one hand with the little finger being positioned on the side near the baton main body and manipulates the baton while controlling the gripping force. The user performs offense and defense by striking an opponent by rotating the baton main body around the axis of the crosshandle while thrusting the baton main body. It is also possible to suddenly halt rotation of the baton main body, perform high speed maneuvers, and to perform a jab from a point outside of the opponent's view. The police baton with crosshandle can, of course, also be used in the same manner as an ordinary "billy club" by gripping the short end of the baton main body.

While a police baton is the preferred means for subduing a single opponent who is already within the grasp of an officer, it is of little use as a means for apprehending a fleeing villain or slowing an onslaught of multiple attackers. In these type of situations a firearm loaded with nonlethal projectiles, such as darts, tear gas canisters or rubber bullets, is preferred. It is possible, however, that in some cases an officer will be carrying a flashlight in one hand and a baton in the other, thereby making access to a firearm awkward and slow in the event of an ambush.

For these reasons, it would be desirable for law enforcement officers and guards to have a single weapon which offers the advantages of both a baton and a sidearm. The device must be able to switch from one dedicated mode to another quickly, and be safe from accidental discharge when used as a baton. It is also desirable for such a device to be inexpensive, and compact, to maintain the element of surprise when used in a jabbing maneuver.

A police baton with crosshandle provided with a shooting device mounted on the crosshandle is described by Ashihara in U.S. Pat. No. 5,108,098 (Apr. 28, 1992). Ashihara's baton is used in the customary fashion with the little finger being closest to the baton main body. By rotatably mounting a shooting device on the end of the crosshandle, Ashihara is able to provide baton motion and the ability to shoot simultaneously, but with added bulk and the possibility of misfire during baton maneuvers.

Another device, described in U.S. Pat. No. 4,989,358 (1991) to Aronson et al., includes an adaptor for the tip of the baton main body which is able to hold a gun. When assembled in such a fashion the baton main body and crosshandle function as a rifle stock for more accurate shooting. The gun must, however, be detached before the device may be used as a baton. Obviously, the act of attaching and detaching a gun requires the use of an additional hand.

A police baton with crosshandle and light or spark emitting means is described in U.S. Pat. No. 4,842,277 (1989) to LaCroix. LaCroix provides external buttons on the side of the baton main body to select the various functions, such as emission of a blinding laser beam or threatening sparks. These types of distractions aid the baton user in baton maneuvers, but are not useful in apprehending a fleeing villain or fending off multiple assailants. Furthermore, the location of the control buttons on the baton main body increase the risk of accidental discharge.

Ordinary batons, or "billy clubs," have sometimes been provided with tear gas launchers, or signal lights, or other devices, but these have not been accurate because of the awkward grip necessitated by their in-line geometry.

SUMMARY OF THE INVENTION

Accordingly, it is an object of the present invention to provide a police baton sidearm which will not inadvertently discharge during use as a baton.

It is another object of the present invention to provide a police baton sidearm which does not employ mechanisms which store mechanical energy in anticipation of use as a sidearm.

It is still another object of the present invention to provide a police baton sidearm with a simple, inexpensive and reliable double action only firing mechanism.

It is yet another object of the present invention to provide a breech loading police baton sidearm which is simultaneously able to be used as a baton or a gun in a comfortable and effective manner.

Another object of the present invention is to provide a breech loading police baton sidearm which is able to be quickly assembled and disassembled for reloading.

Yet another object of the present invention is to provide a breech loading police baton sidearm which is able to be quickly assembled and disassembled for reloading using only one hand.

These objects and others not specifically enumerated are accomplished with a police baton sidearm having a baton main body and a crosshandle which is attached in a perpendicular manner to the baton main body at a position longitudinally displaced from the geometric center of the baton main body. The baton main body also houses a recessed trigger ahead of the crosshandle and means for launching a projectile. In order to achieve impact insensitivity a double action only firing mechanism is employed. The baton main body is constructed in two parts to accomodate breech loading and various connection schemes including interrupted and multilead threads on abutting portions of the baton main body. Guide rods or a hinge mechanism may be provided to accomodate one-handed loading. The police baton sidearm may also be equipped with gunsights and a laser pointing device for improving the accuracy of the user's aim.

BRIEF DESCRIPTION OF THE DRAWINGS

The preferred embodiments of the present invention will be described with reference to the accompanying drawings in which.

DESCRIPTION OF THE PREFERRED EMBODIMENTS

Figure 1:
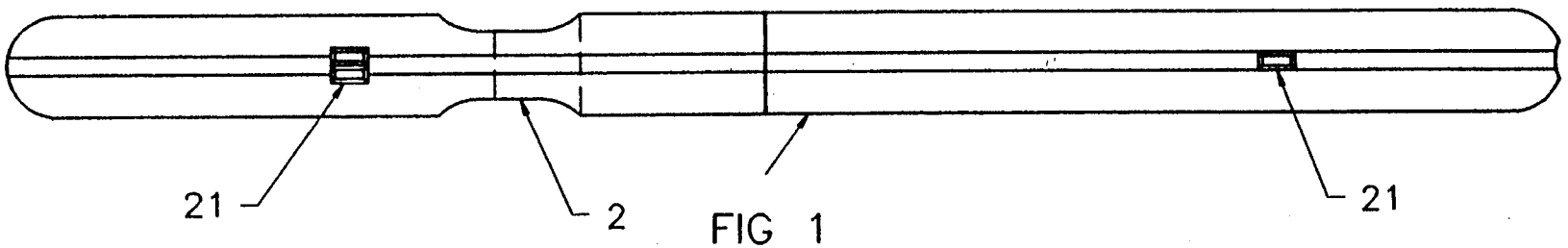
FIG. 1 is a side and top view of the police sidearm baton of the present invention.
Figure 1A:
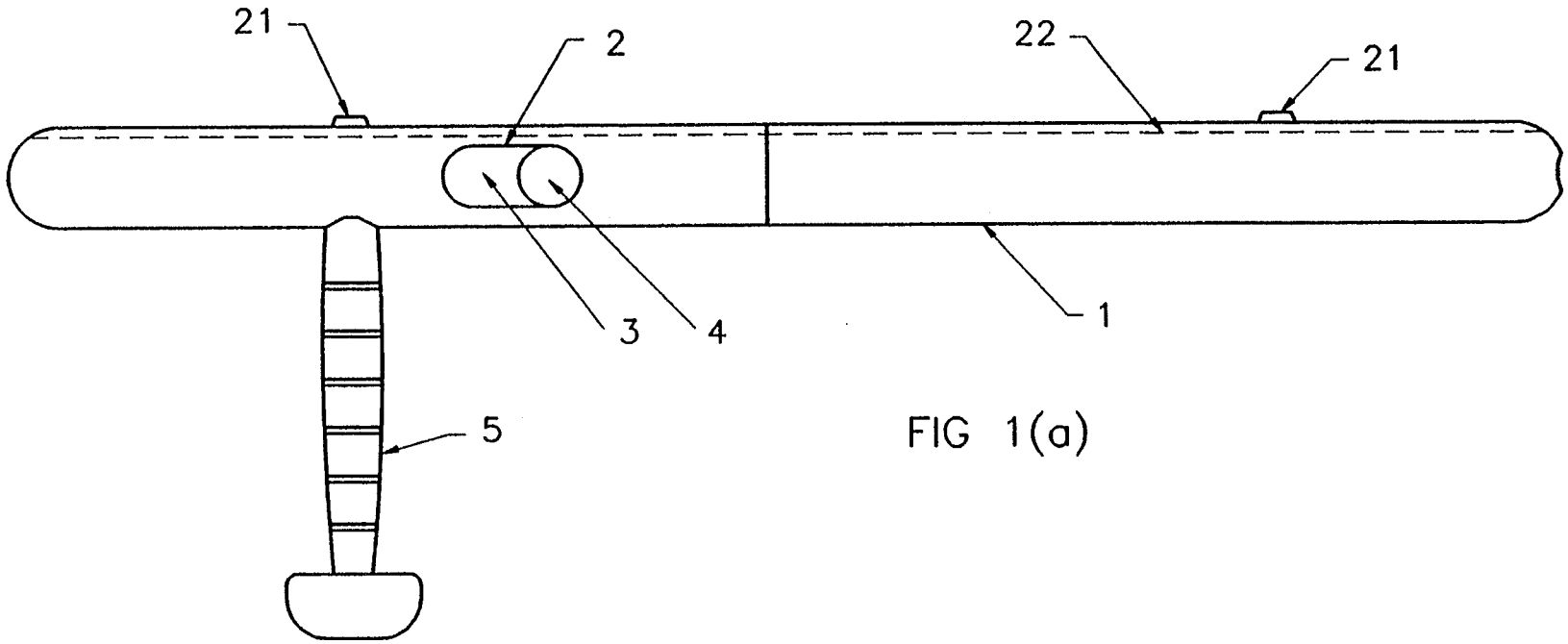

The invention incorporates a projectile launcher, or gun, within a police sidearm baton. " Plan and side views are shown in FIG. 1 and FIG. 1 (*a*), respectively. The standard police baton and the present invention are both provided with a cylindrical main body 1 and a perpendicular cross handle 5 which is used to rotate the main body 1. The cylindrical main body 1 is typically one and a half to two feet in length, and one to two inches in diameter. Common materials for the main body 1 and cross handle 5 are injected molded plastic, aluminum, and wood.

While the overall dimensions of the invention approximate those of the standard issue police weapon, the present invention also utilizes the cylindrical section of the baton 1 as a gun barrel, and incorporates a through-slot 2 which accommodates a trigger plate 3. The trigger plate 3 has a through hole 4 for a trigger finger to pass and is located forward of the T-handle (or crosshandle) 5 in such a position as to make grasping and pulling the trigger plate 3 comfortable for the user. In addition, the device is equally useable by right or left-handed shooters.

Figure 2:
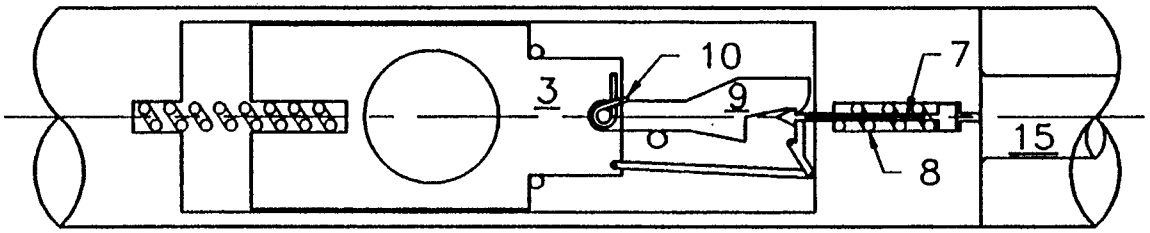
FIG. 2 is a sectional view of the triggering mechanism of the present invention prior to any lateral translation of the trigger plate.

The firing mechanism, illustrated in FIG. 2, is designed to be as simple, yet as safe, as possible. It is disposed entirely within the baton main body 1 and consists of only five moving parts and three springs. The triggering mechanism functions according to "double action only" principles. A distinguishing feature of double action only firing mechanisms is that they store no energy before the trigger is pulled, as would the familiar cocked hammer or firing pin spring of conventional devices. This greatly reduces the possibility of accidental discharge due to impact, sear failure or light trigger pull.

Referring now to FIG. 2, the trigger mechanism is comprised of a firing pin 7 which is constantly sprung in the forward direction by the firing pin spring 8. Both the firing pin 7 and the firing pin spring 8 are of a type commonly used to initiate small arms ammunition. The firing pin spring 8 stores energy during trigger pull and accelerates the firing pin 7 into the cartridge primer 15 after sear 9 releases. The trigger plate 3 is pinned to the sear 9 with a torsional spring 10 at the point of attachment, in order to maintain engagement of the sear 9 with the firing pin 7 at all times.

Figure 3:
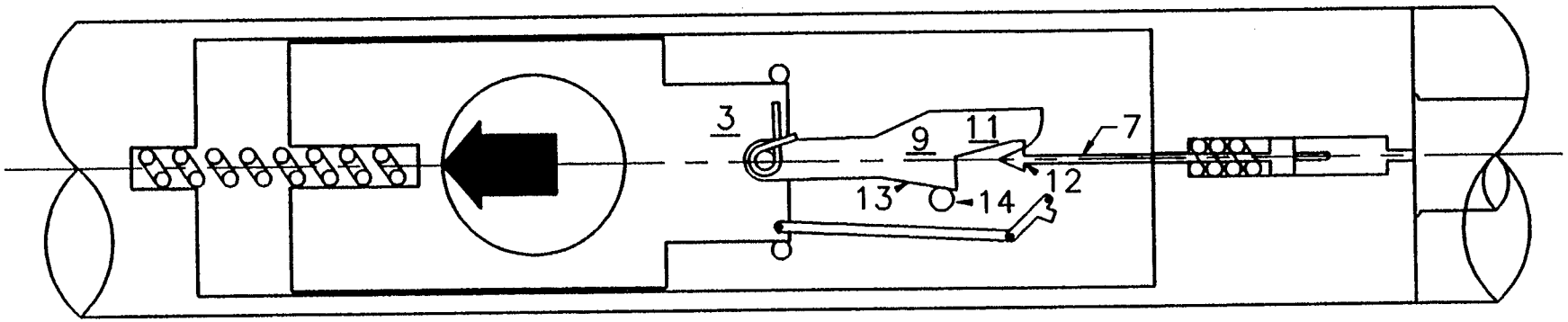
FIG. 3 is a sectional view of the triggering mechanism of the present invention immediately before release of the firing pin.

As shown in FIG. 3, the claw end 11 of the sear 9 engages a shoulder on the rear 12 of the firing pin 7 and pulls the firing pin 7 back as the trigger plate is pulled rearward. A tapered section on the sear 9 is designed to slide along a pin 14 which is fixed to the baton main body 1, causing rotating the sear 9 upwards. The pin 14 is positioned such that the sear 9 will release the firing pin 7 as the trigger plate 3 reaches its rearmost position.

Figure 4:
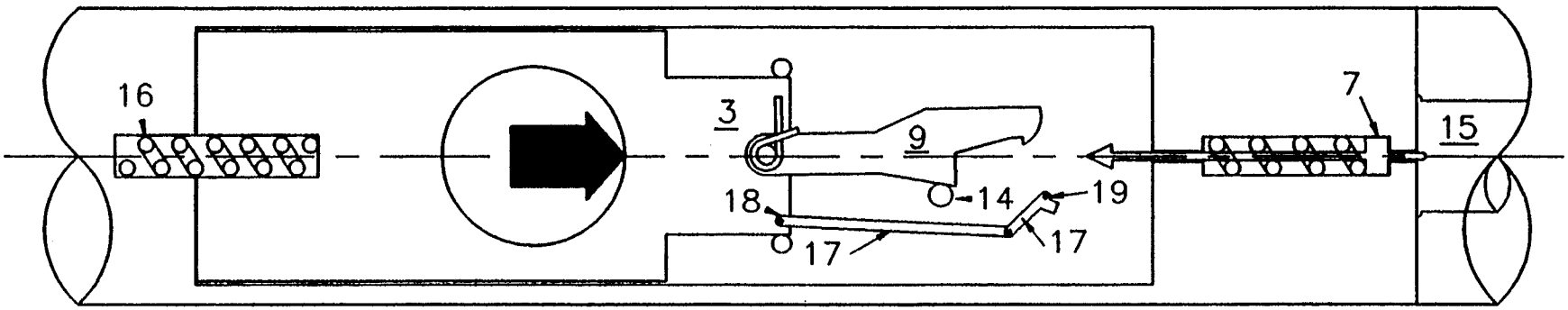
FIG. 4 is a sectional view of the triggering mechanism of the present invention immediately after release of the firing pin.
Figure 5:
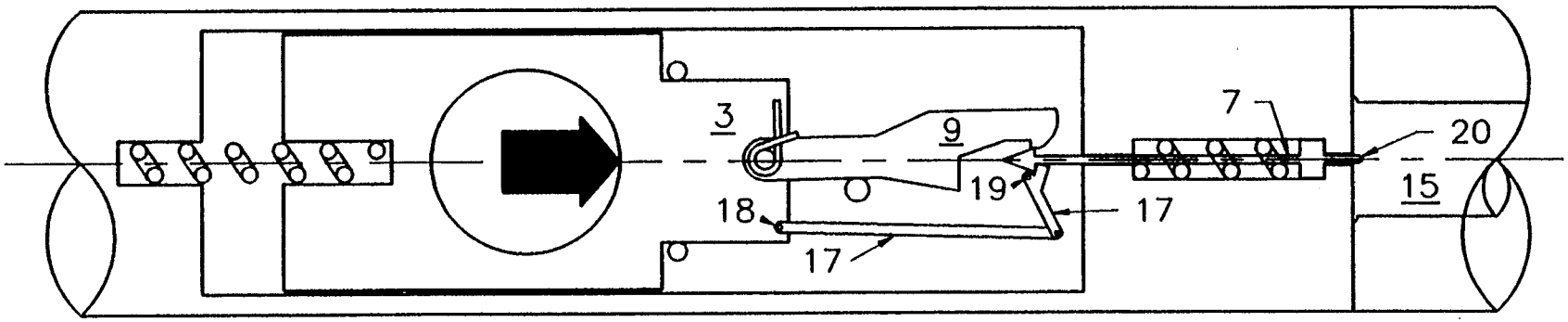
FIG. 5 is a sectional view of the triggering mechanism of the present invention during re-engagement.

As shown in FIG. 4, the firing pin 7 then accelerates into the primer 15 and impacts with ample energy to produce ignition. Now, as the trigger plate 3 is released it returns to its forward, or home, position under the tension of the trigger return spring 16. Also occurring at this point, and as illustrated in FIG. 5, the retract linkages 17, which are pinned 18 to the trigger plate 3 and baton main body 1, rotate to pull the firing pin 7 back far enough to allow the sear 9 to engage. This retracts and secures the head of the firing pin 7 from touching the primer 15 of the next cartridge to be chambered.

For aiming purposes, the weapon includes open sights 21 and a sight trough both of which are shown in FIG. 1. The sights 21 are preferably made of a compliant material, such as a high density polyethylene, a nylon or any other elastomer, so as to prevent injury during baton strikes. In addition, a laser sight 23 such as that shown in FIG. 6 can be mounted within or external to the baton main body 1 and activated by means of a pressure switch 24 located near the tip of the baton main body 1. The open sights 21 and laser sighting device 23 are typical of those commonly employed by manufacturers of sidearms, save the compliant nature of the open sighting device 21. In particular, a standard laser diode and power source may be used as a laser sighting device 23.

Figure 6:
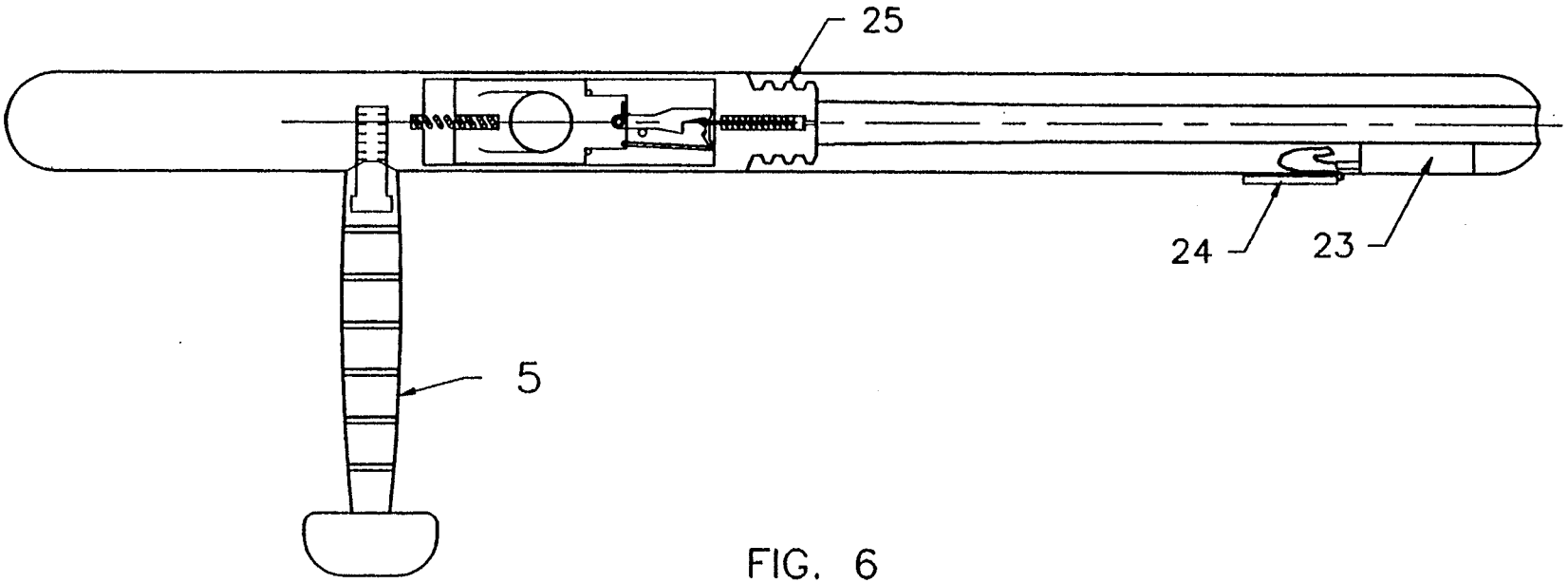
FIG. 6 is a sectional view of a police sidearm baton having a laser sighting device and a bipartite baton main body comprising a threaded breech.
Figure 6B:
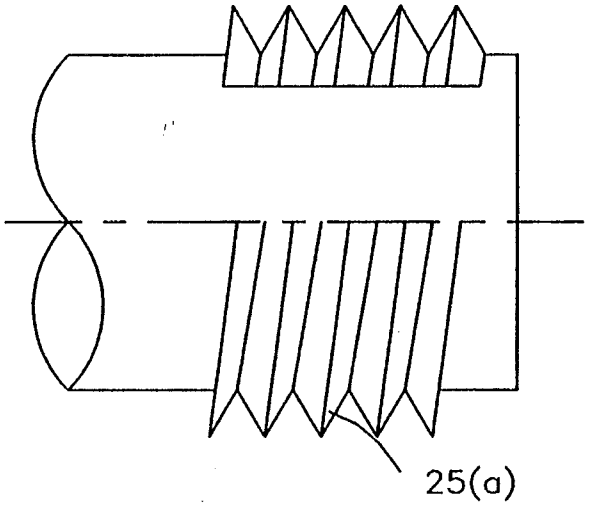
Figure 6A:
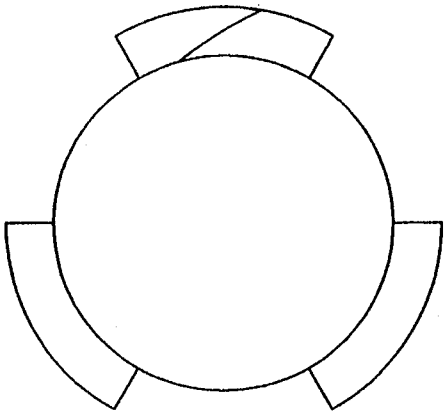
Figure 6C:
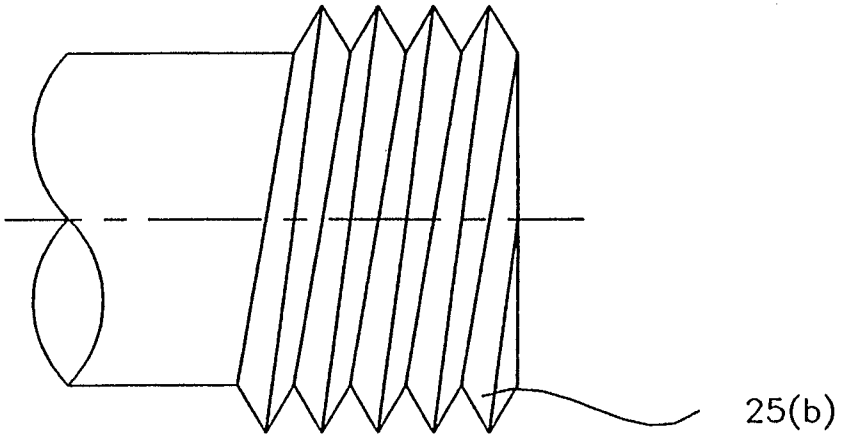

A first mechanism for allowing the breech to be opened, cleared and reloaded is shown in FIG. 6. In this embodiment, the baton main body 1 is bipartite, having a forward half 35 which is bored out and threaded internally to receive the rear half 36 which is provided with external threads 25. In addition, either an interrupted thread 25*a* as shown in FIG. 6*a* or a multiple lead thread 25b as shown in FIG. 6b may be used in order to reduce the amount of rotation necessary to unlock the two parts of the baton main body 1. This, in turn, facilitates quick loading and reloading of the sidearm baton. The disadvantage to this approach is that it generally requires two hands to separate the baton main body 1.

Figure 7:
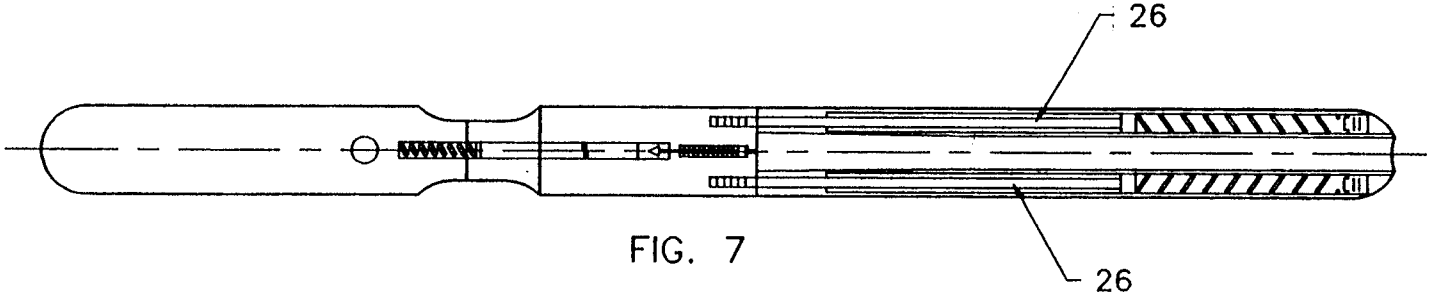
FIG. 7 is a sectional view of a police sidearm baton having a laser sighting device and a bipartite baton main body provided with longitudinal guide rods and a clasping mechanism.
Figure 7A:
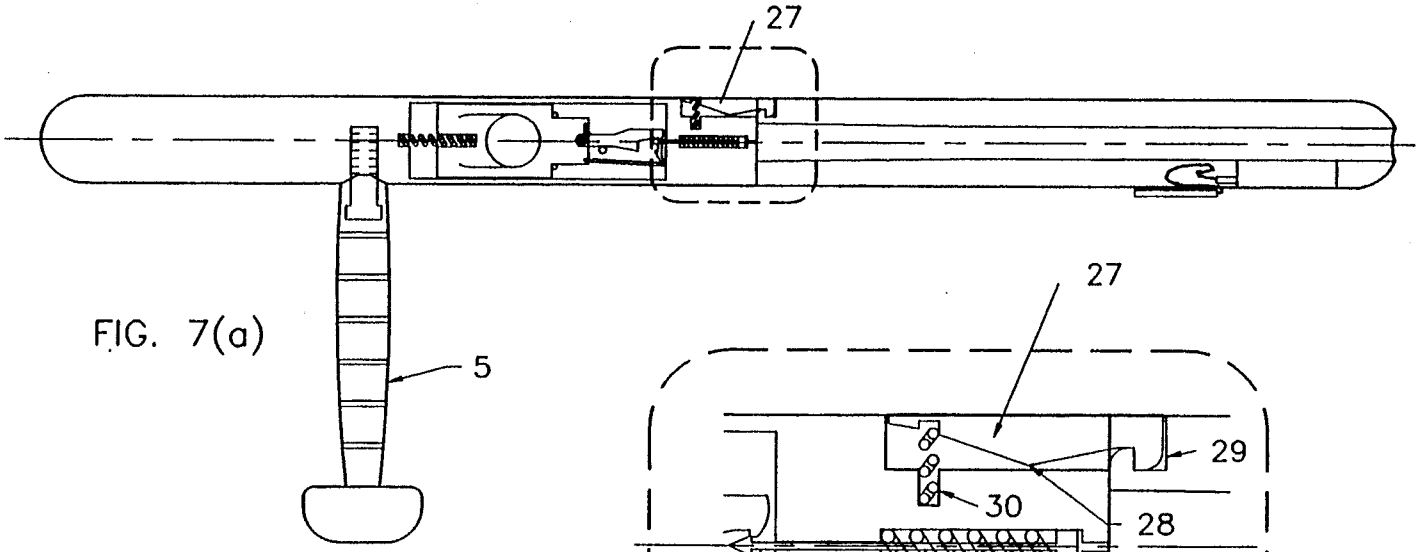
Figure 7B:
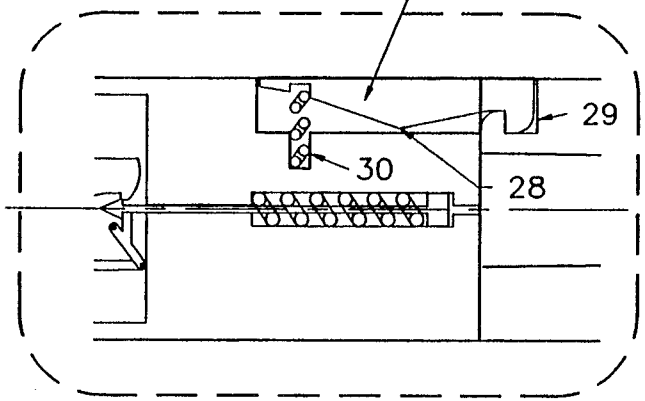

A second breech mechanism, illustrated in FIG. 7, employs several guide rods 26 which run parallel to the gun bore 37 and are fixed to the rear body 35. These rods 26 provide alignment and mechanical strength between the two baton sections 35 and 36. In order to hold the breech closed, a pivoting clasp pin 27, as illustrated in FIG. 7 (*a*) and (*b*), is attached with a pin 28 into the rear body 35 and made to protrude into a slot 29 in the forward body 36. The clasp 27 is spring-loaded from the bottom to maintain constant force on the rear portion of the clasp 27 thereby preventing accidental opening of the breech. In operation, the user merely depresses the rearmost portion of the clasp 27 to pivot the forward portion out of the slot 29. The forward portion 36 may then be flipped over to expose the gun chamber for reloading and other purposes. This action may be accomplished with one hand, leaving the other hand free to hold ammunition, or to fend off an unexpected attack.

Figure 8:
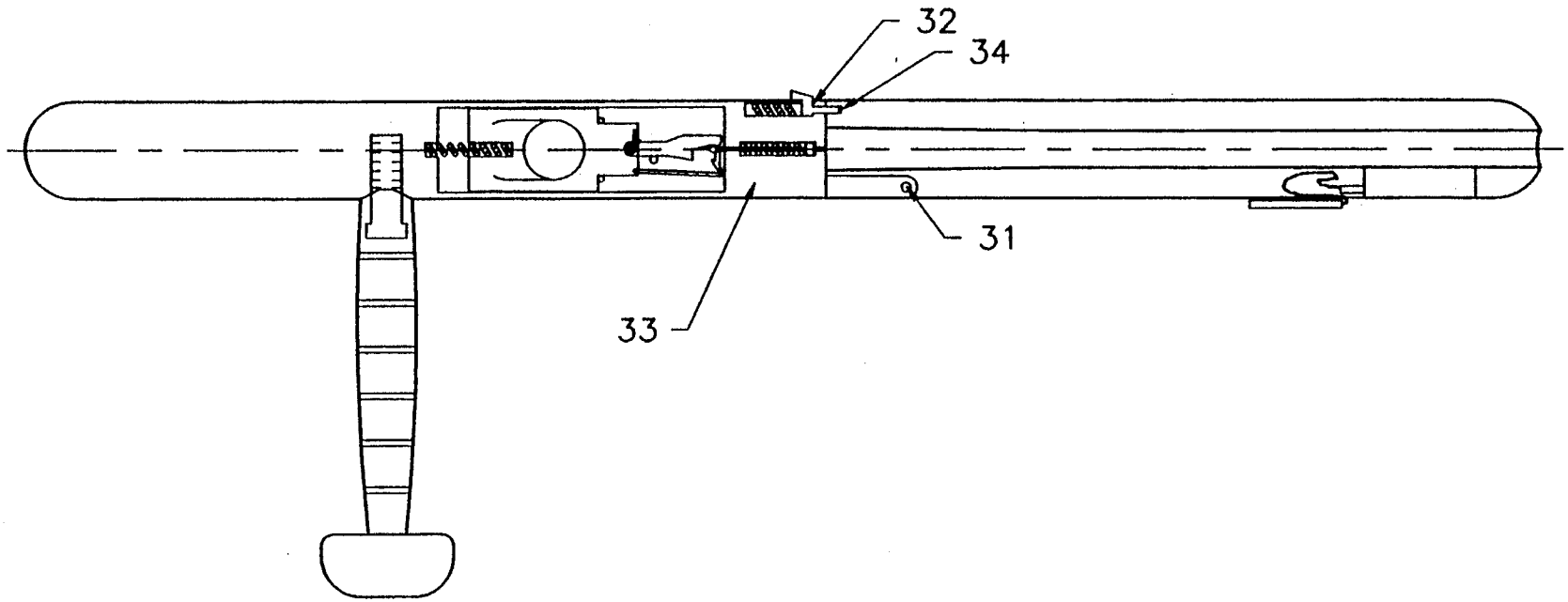
FIG. 8 is a sectional view of a police sidearm baton having a laser sighting device and a bipartite baton main body provided with an integral hinge and clasping mechanism.

A third type of breech mechanism is shown in FIG. 8. An integral hinge 31 is attached to the two baton sections 35 and 36, which are then clasped with a spring closure pin 32. The pin 32 protrudes from the rear baton body 35 into a hole 34 in the forward body 36 thereby holding the breech closed. To open the breech, the user translates the pin 32 rearward and flips the forward portion 36 of the main baton body 1 downward. As with the second breech mechanism described, breech opening may be accomplished with one hand.

The embodiments described herein and shown in the drawings are not exhaustive, but merely exemplary, of the types of breech mechanisms encompassed by the present invention. Other breech mechanisms may be used, as well as modifications of, and additions to, the breech opening mechanisms disclosed.

Furthermore, while specific embodiments of the baton and double action only triggering mechanism have been disclosed, it will be obvious that various changes, modifications and additions can be made without departing from the field of the invention which should be limited only by the scope of the appended claims.

I claim:

1. In a police baton sidearm having a baton main body with a interior hollow and geometric center therein, a cross handle, and means disposed within said main body for launching a projectile, wherein said cross handle is attached perpendicularly to the main baton body and longitudinally displaced from the geometric center of said main body, the launching means comprising a through hole in the main body communicating with the interior hollow, a recessed, trigger plate slidably mounted in the interior hollow adjacent to said through hole, a double action only firing means connected to said trigger, a breech, firing chamber and gun barrel disposed within said baton main body, the double firing means having a firing pin located between the trigger and the breech, wherein the improvement comprising structural arrangement of liner acting trigger means in line with the firing pin that slides in the interior hollow of the main body.

2. A police baton sidearm in accordance with claim 1 comprising first tensioning means for urging said firing pin toward said breech, cam means attached to said trigger and provided with a latch for engaging translating and subsequently releasing said firing pin during translation of said trigger toward said crosshandle and second means for returning said trigger to its original position so that the cam may once again latch onto said firing pin rendering the weapon inactive until such time as the trigger is pulled.

3. A police baton sidearm according to claims 1, or 2 wherein said baton main body comprises abutting forward and aft portions to provide a breech, said forward portion housing a gun barrel and firing chamber to allow breech loading, and said aft portion housing said recessed trigger and double action only firing means.

4. The police baton sidearm of claim 3 wherein abutting ends of said forward and aft portions are provided with interrupted threads to facilitate quick assembly and disassembly of said baton main body.

5. The police baton sidearm of claim 3 wherein abutting ends of said forward and aft portions are provided with multiple lead threads to facilitate quick assembly and disassembly of said baton main body.

6. The police baton sidearm of claim 3 further provided with one or more guide rails disposed within said baton main body to allow a finite lateral translation of said forward and aft portions of said baton main body relative to one another so that one-handed loading is possible, said police baton sidearm further provided with clasping means to prevent inadvertent separation of said forward and aft portions of said baton main body.

7. The police baton sidearm of claim 3 further comprising a hinge connecting abutting faces of said forward and aft portions of said baton main body to facilitate one-handed loading, said police baton sidearm further provided with clasping means to prevent inadvertent separation of said forward and aft portions of said baton main body.

8. The police baton sidearm of claim 3 further comprising sighting means circumferentially opposed to said crosshandle.

9. The police baton sidearm of claim 3 wherein said baton main body is provided with laser pointing means for assisting the user in target acquisition.

* * * * *